US006723940B1

(12) United States Patent
Book et al.

(10) Patent No.: US 6,723,940 B1
(45) Date of Patent: Apr. 20, 2004

(54) ENCAPSULATED MAGNETICALLY ACTUATED VACUUM INTERRUPTER WITH INTEGRAL BUSHING CONNECTOR

(75) Inventors: William J. Book, Jefferson City, MO (US); Guenter Leonhardt, Ratingen (DE)

(73) Assignee: ABB Inc., Raleigh, NC (US)

( * ) Notice: Subject to any disclaimer, the term of this patent is extended or adjusted under 35 U.S.C. 154(b) by 0 days.

(21) Appl. No.: 09/958,784

(22) PCT Filed: Apr. 13, 2000

(86) PCT No.: PCT/US00/10028

§ 371 (c)(1),
(2), (4) Date: Jan. 15, 2002

(87) PCT Pub. No.: WO00/62319

PCT Pub. Date: Oct. 19, 2000

Related U.S. Application Data

(60) Provisional application No. 60/129,004, filed on Apr. 13, 1999.

(51) Int. Cl.[7] ..... H01H 33/02

(52) U.S. Cl. ..... 218/155; 218/154; 218/97

(58) Field of Search ..... 218/154, 155, 218/42, 43, 118, 121, 124, 127–130, 134, 135, 139

(56) References Cited

U.S. PATENT DOCUMENTS 3,626,125 A * 12/1971 Tonegawa ..... 218/122
4,171,474 A 10/1979 Holmes ..... 200/144 B
4,267,415 A 5/1981 Holmes et al. ..... 200/144 B
5,059,753 A 10/1991 Hamm ..... 200/148 F
5,597,992 A 1/1997 Walker ..... 218/121
5,793,008 A 8/1998 Mayo et al. ..... 218/129
5,912,604 A * 6/1999 Harvey et al. ..... 335/9
6,331,687 B1 * 12/2001 Dunk et al. ..... 218/140

OTHER PUBLICATIONS

WO 96 36982 Dunk et al et al Nov. 21, 1996.*

* cited by examiner

*Primary Examiner*—Lincoln Donovan
*Assistant Examiner*—Marina Fishman
(74) *Attorney, Agent, or Firm*—Woodcock Washburn LLP

(57) ABSTRACT

Apparatus (10) for interrupting the flow of current in a power distribution system is disclosed for use with an enclosure containing insulating fluid. The apparatus (10) includes a housing (20) formed from insulating material and having a mounting flange (28) formed along the exterior of the housing (20). The flange (28) is located so that the housing extends away from the mounting side and the upper side of the flange. An electrical current interrupter (16), having electrical input and output ends (16*a*, 16*b*), is positioned in the housing (20) so that a portion lies within the portion of the housing extending away from the flange mounting side. An actuator (12) is mechanically connected to the interrupter (16) to provide the mechanical actuation required to interrupt the current flow between the input and output ends of the interrupter. When the flange (28) is attached to the enclosure, the portion of the housing (20) extending away from the flange mounting side extends into the fluid within the enclosure.

8 Claims, 5 Drawing Sheets

ENCAPSULATED MAGNETICALLY ACTUATED VACUUM INTERRUPTER WITH INTEGRAL BUSHING CONNECTOR

This application claims the benefit of provisional application Ser. No. 60/129,004 filed Apr. 13, 1999.

FIELD OF THE INVENTION

The present invention relates to interrupter switch and transformer combinations used in power distribution systems and, more particularly, to the combination of a magnetically actuated vacuum interrupter switch and an oil-filled distribution transformer, the switch being for controlling power to the transformer or the loop connection through the transformer.

BACKGROUND OF THE INVENTION

When interrupting current to an inductive load, an arc can form between the separating switch contacts. For many years, the practice in the electrical power distribution industry has been the use of loadbreak switching in which contact arcing generated during current interruption physically occurs in an insulating fluid contained within an enclosure. However, the fluids historically in use, such as mineral and silicone oils, are limited in their arc-quenching capabilities. The existence and process of extinguishing the arc causes a breakdown of the insulating medium. In general, when arcing occurs physically within the insulating oil, contamination of the oils results from the formation of by-products. Moreover, gas is generated which acts to raise the system pressure. Venting the enclosure containing insulating oil may be required. Such venting adds to the complexity of the enclosure design. However, liquids are advantageous because of their low cost, ready availability and ease of handling and storage.

Unlike oil, there are no by-products resulting from arc in vacuum or an enclosure containing $SF_6$ gas. Any by-products, formed as a result of arcing in $SF_6$ gas, tend to recombine into the gas after a short period of cooling. No harmful residues are left in the system. No insulation is lost and no venting is required.

Consequently, a need exists for an interrupter that has the insulating characteristics of oil and which does not suffer from disadvantages resulting from the formation of by-products.

SUMMARY OF THE INVENTION

The foregoing disadvantages of fluid degradation during switching are overcome by apparatus for interrupting the flow of current in a power distribution system for use with an enclosure containing insulating fluid. The apparatus includes a housing formed from insulating material and having a mounting flange formed along the exterior of the housing. The flange is located so that the housing extends away from the mounting side and the upper side of the flange. An electrical current interrupter, having electrical input and output ends, is positioned in the housing so that a portion lies within the portion of the housing extending away from the flange mounting side. An actuator is mechanically connected to the interrupter to provide the mechanical actuation required to interrupt the current flow between the input and output ends of the interrupter. When the flange is attached to the enclosure, the portion of the housing extending away from the flange mounting side extends into the fluid within the enclosure.

Preferably, the interrupter is either a vacuum interrupter or an interrupter filled with an insulating fluid such as $SF_6$ gas. It is also preferred for the actuator to be a magnetic actuator.

In one embodiment the housing comprises an arm member and a base member, preferably integrally formed. A conductor is connected to the electrical output of the interrupter. It is especially preferred for the base member to be molded around a portion of the conductor. It is also preferred for a current sensor, such as a current transformer, to be positioned proximate the conductor for sensing the current flowing there through.

It is also preferred for a flexible conductor to be electrically connected between the output end of the interrupter and the conductor. In such an embodiment, an insulating rod is mechanically interconnected between the actuator and the output end of the interrupter.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION OF THE PREFERRED EMBODIMENTS

The prior disadvantages of fluid degradation during switching is moderated or nullified in distribution transformers in accordance with the invention by a new system of enclosing small vacuum interruptor switches and their interconnections within larger tanks filled with a conventional insulating and cooling mineral oil. This combination of two insulating systems obtains the maximum benefits of both while minimizing the shortcomings of both for their specific applications. All of the advantages of load switching in a vacuum are retained while the industry-standard bushings and conductors, and the switching modules themselves, are insulated and cooled by the long established benefits and economy of mineral oil liquid.

The invention also includes a magnetically driven actuator to drive the vacuum interrupter contacts "open" and "closed." The use of a magnetic drive provides for improved reliability (fewer parts) and the ability to employ remote operation without the use of expensive, motor-driven spring charging mechanisms.

Figure 1:
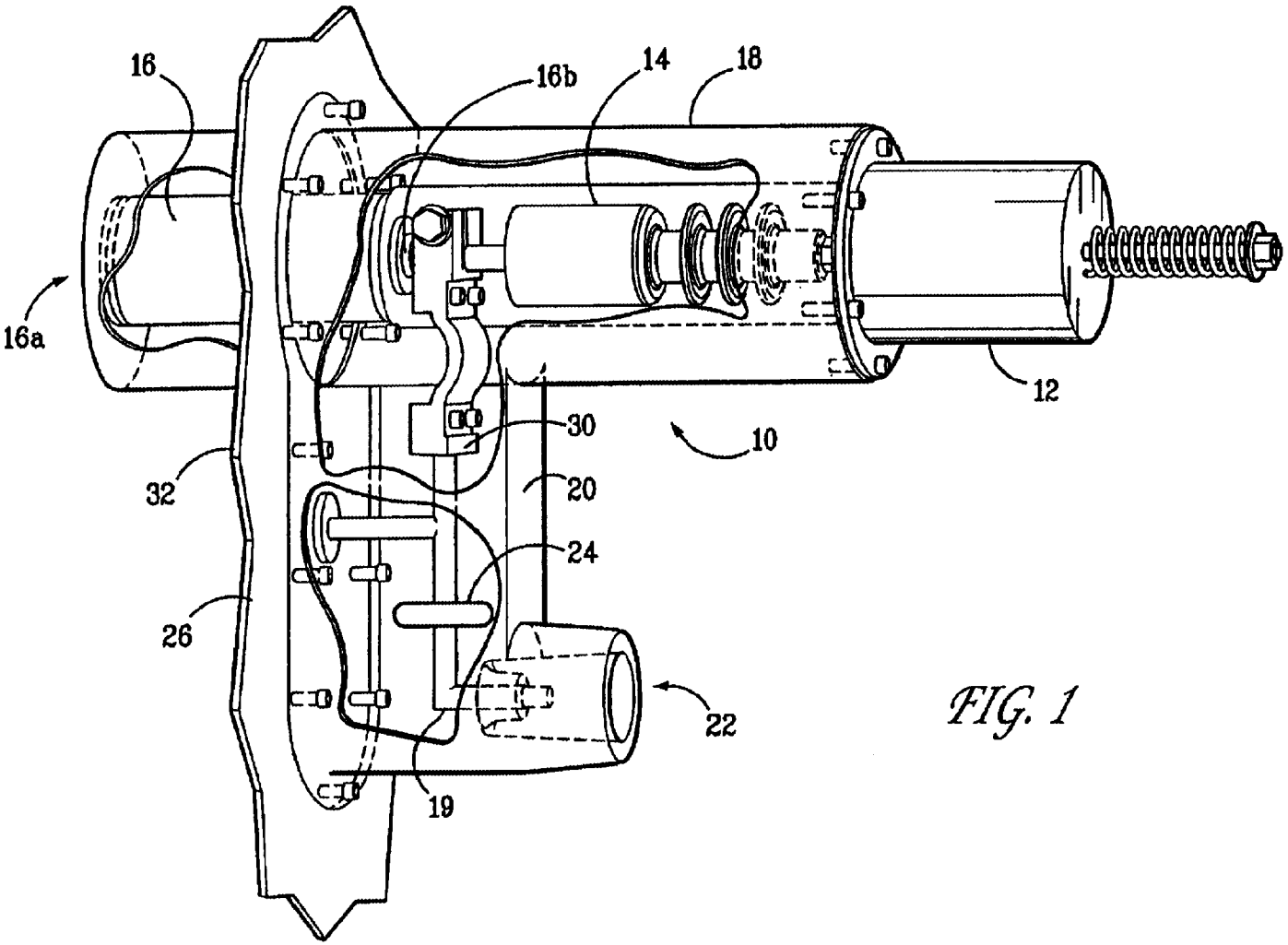
FIG. 1 is a diagrammatic perspective view of an encapsulated magnetically actuated interrupter with integral bushing connector constructed in accordance with the invention.
Figure 2:
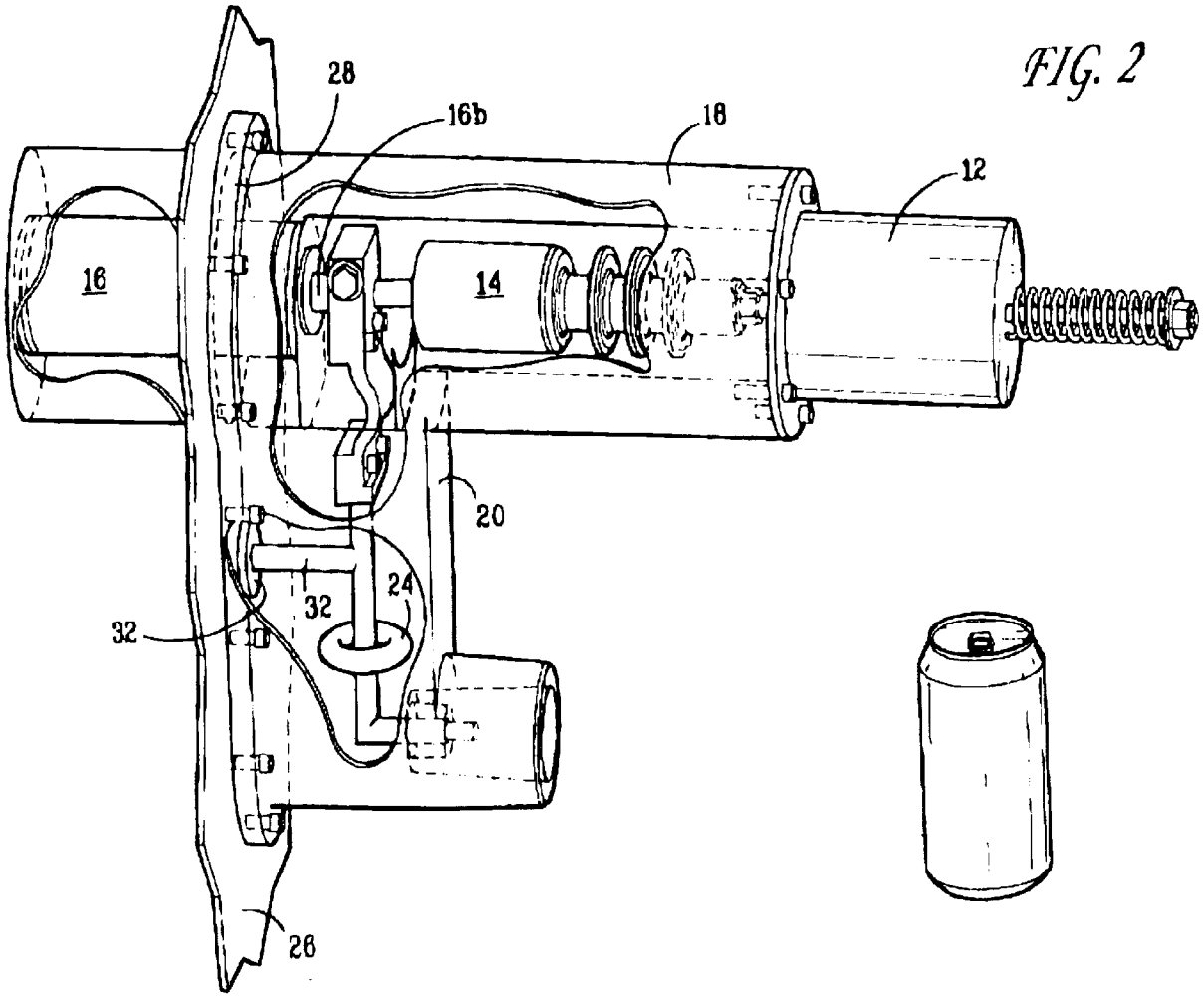
FIG. 2 is a diagrammatic perspective view of the encapsulated magnetically actuated interrupter with integral bushing connector shown in FIG. 1, from a different angle.
Figure 3:
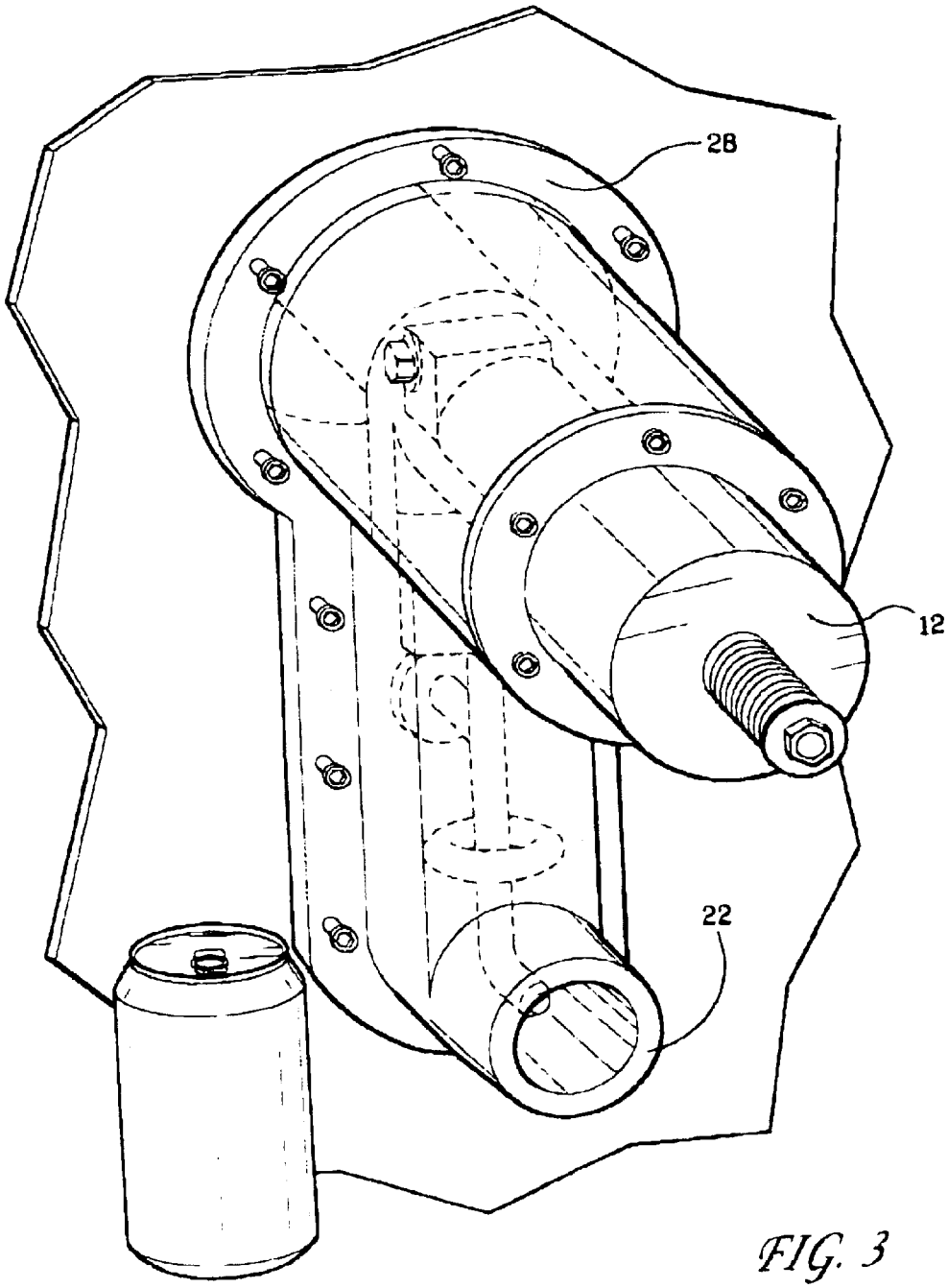
FIG. 3 is a diagrammatic perspective view of the encapsulated magnetically actuated interrupter with integral bushing connector shown in FIG. 1, from a different angle.

Referring to FIGS. 1, 2 and 3, and integrated interrupter device 10 is depicted. Device 10 is shown to include a magnetic actuator 12 coupled via insulating rod 14 to vacuum interrupter 16. Magnetic actuator 12 drives the arrangement. To that end, it is noted that the position of rod 14 as determined by the state of actuator 12 will cause interrupter 16 to be in either an opened or closed state. It is noted that no particular interrupter is necessary to practice the invention, however, it is desirable that interrupter 16 include an electrical input end 16*a* and an electrical output end 16*b*. When interrupter 16 is mechanically actuated, by operation of magnetic actuator 12 and insulating rod 14, the flow of current between input and output ends 16*a* and 16*b* will either be interrupted or permitted to flow. Typically output end 16*b* will be an electrically conductive rod that extends into interrupter 16 and is caused by operation of actuator 12 to either make contact or break contact with a second rod forming a portion of electrical input 16*a*.

The opened or closed state of interrupter 16 will, in turn, either permit or interrupt the flow of current from a source (not shown). When current is permitted to flow, the current path is from interrupter 16 through flexible conductor 30 and conductor 19 to bushing connector 22. The flexible current path connector 30, of any suitable contemporary design, is included for permitting current flow in the presence of the axial movement of rod 14, i.e., the flexibility of connector 30 permits its mechanical attachment to rod 14 and its electrical attachment to the conductor (shown in FIGS., 1, 2, 4 and 5) extending from actuator 16.

The interrupter and actuator are encapsulated in arm 18 and base 20, each being formed from solid dielectric material, preferably urethane, epoxy or other known electrically insulating material. As depicted in FIGS. 1, 2 and 3, arm 18 and base 20 are integrally formed, preferably molded. Bushing connector 22, also included within base 20, is preferably constructed similar to those connectors described in ANSLTEEE Standard 386-1985 (FIG. 3 for 200A interface or FIG. 10 for 600A interface). It is noted that since rod 14 will exhibit axial movement and since flexible connector 30 will flex laterally, chambers of a size sufficient to permit such movement are formed in arm 18 and base 20. A flange or mounting pad 28 is formed around a portion of base 20 and arm 18. As described below, flange 28 serves to mount device 10 onto another structure such as a container filled with insulating oil.

Device 10 is mounted to the sidewall 26 of a transformer by mounting pad 28. In a preferred embodiment, sidewall 26 forms a part of an enclosure containing an insulating fluid such as mineral or silicone oil. Such materials (mineral and silicone oils) are well suited to insulating and cooling purposes. By immersing a portion of interrupter 16 into such fluid, any arcing occurring within the interrupter can be insulated and cooled by the oil. Moreover, either by filling interrupter 16 with an insulating fluid such as $SF_6$ gas or by forming a vacuum therein, the risk of harmful degradation has been minimized. In this way, the benefits of each medium can be utilized.

The single piece or molded construction of base 20 is also shown to include integrated current and voltage sensors, such as current sensor 24, for both line sensing and self-powering (not shown). A loop feeder tap 32 is provided in the molded construction as an extension of conductor 19 for a loop-feed connection through wall 26 and into the transformer.

Although the magnetic actuator 12 can be of any particular form, it is desirable to utilize the magnetic actuator disclosed in co-pending patent application Ser. No. 08/794,491 filed Feb. 4, 1997 entitled MOLDED POLE AUTOMATIC CIRCUIT RECLOSER WITH BISTABLE ELECTROMAGNETIC ACTUATOR, incorporated herein by reference.

The device 10 also includes connection points for control devices (most likely in the air compartment).

Figure 4:
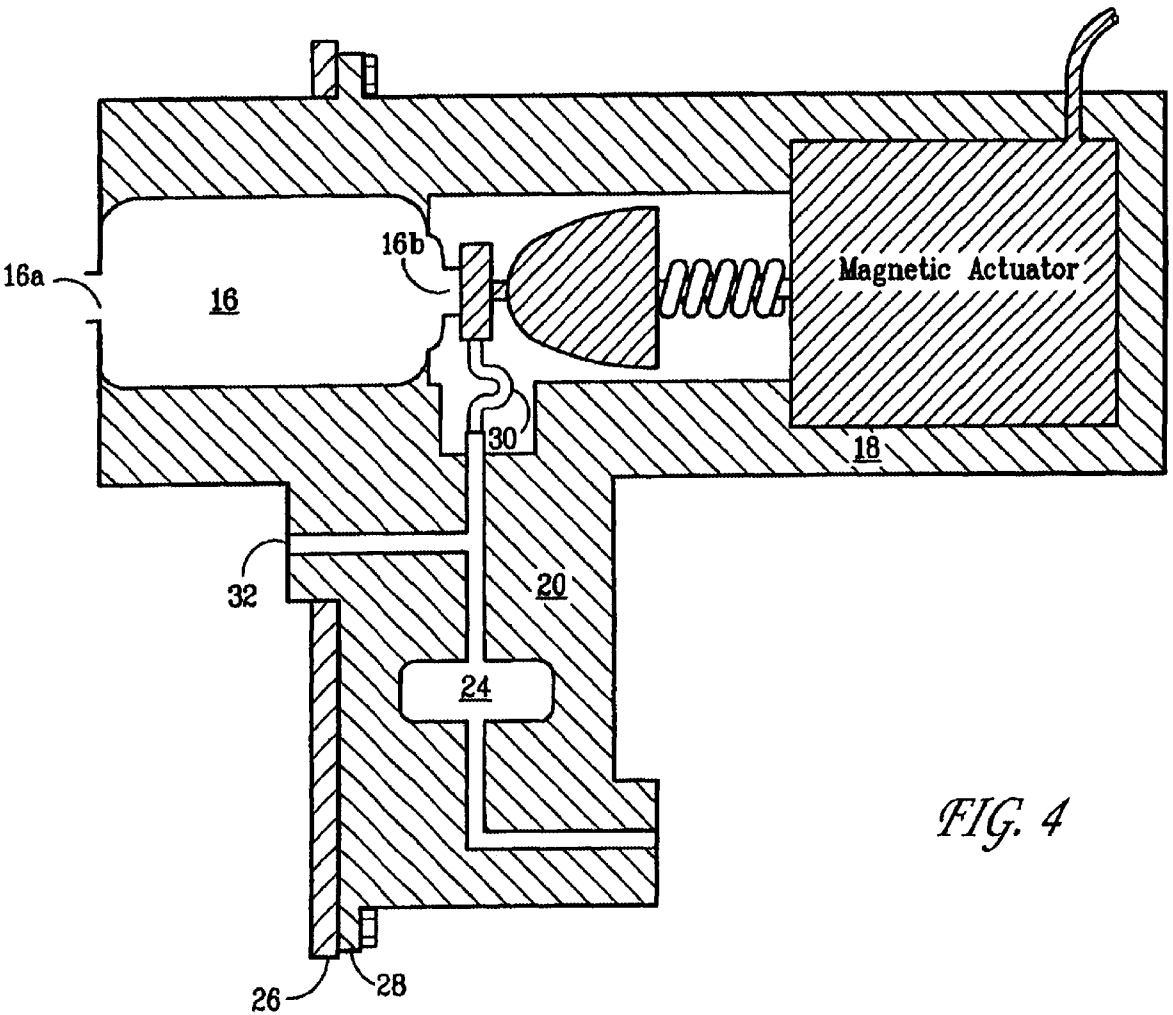
FIG. 4 is a side diagrammatic view of an alternate embodiment of the encapsulated magnetically actuated interrupter with integral bushing connector shown in FIG. 1.

FIG. 4 depicts an alternative embodiment of device 10, in which a different magnetic actuator is utilized. In this embodiment, the magnetic actuator is contained within arm 18. In the FIG. 1 embodiment, actuator 12 was mounted to the end of arm 18.

Figure 5:
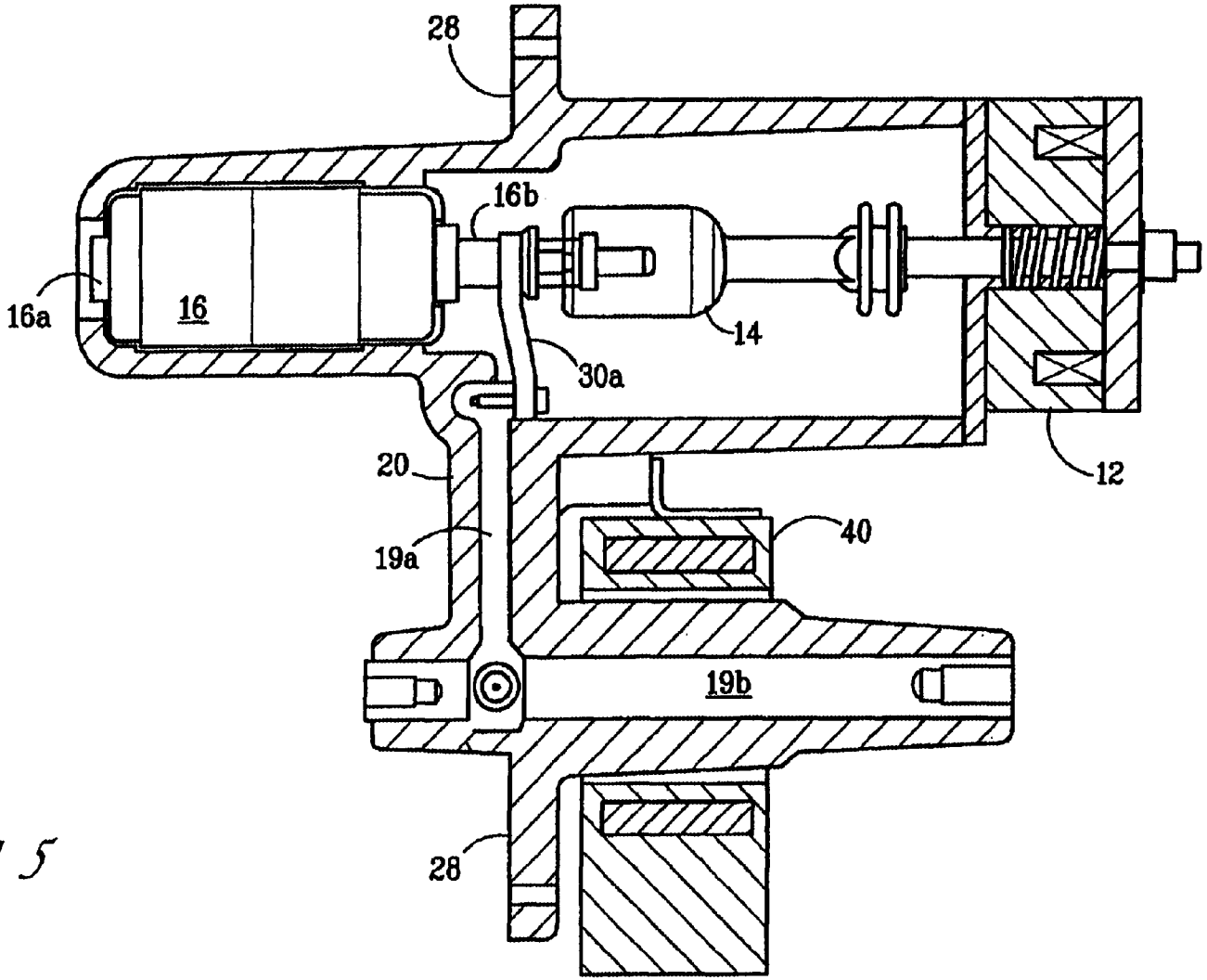
FIG. 5 is a diagrammatic section view of an alternate embodiment of the encapsulated magnetically actuated interrupter with integral bushing connector shown in FIG. 1.

Referring now to FIG. 5, yet another embodiment of device 10 is shown. In this embodiment, connector 30*a* is connected to conducting rods 19*a* and 19*b*. A current or voltage sensor 40 is positioned to surround conducting rod 19*b* to detect the current passing there through.

The advantages of this device are numerous: 1) clean interruption by eliminating arching in the oil, 2) reliable operation through the use of magnetic actuators which contain a minimal number of moving parts, 3) flexibility (with the addition of control devices of varying degrees of sophistication the device can perform the duties of a load-break switch, resettable fuse, recloser and circuit breaker) and 4) the integration of bushing connector 22 makes the unit compact and eliminates manual joint connections necessary in present day solutions.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A power-distribution system, comprising a transformer having an enclosure for holding an insulating liquid, and a device for interrupting a flow of current in the power distribution system, the device comprising:

an interrupter comprising an electrical input end and an electrical output end, the interrupter interrupting a flow of current between the electrical input end and the electrical output end in response to a mechanical input to the interrupter;

an actuator mechanically connected to the interrupter for providing the mechanical input to the interrupter;

a housing enclosing the interrupter and the actuator; and a mounting pad mechanically coupled to the housing, the mounting pad being fixedly coupled to the enclosure so that at least a portion of the interrupter extends into the enclosure and a portion of the housing surrounding the interrupter is immersed in the insulating liquid.

2. The power-distribution system of claim 1, wherein the housing comprises an arm and a base.

3. The power-distribution system of claim 2, wherein a first portion of the arm extends from the mounting pad in a first direction, a second portion of the arm extends from the mounting pad in a second direction substantially opposite the first direction, and the first portion of the arm is immersed in the insulating liquid when the housing is mounted on the enclosure.

4. The power-distribution system of claim 3, wherein the interrupter is located at least in part within the first portion of the arm and the actuator is located within the second portion of the arm.

5. The power-distribution system of claim 1, wherein the housing encapsulates the interrupter and the actuator.

6. The power-distribution system of claim 1, wherein the interrupter is filled with an insulating gas.

7. The power-distribution system of claim 1, wherein the interrupter has a vacuum formed therein.

8. The power-distribution system of claim 1, wherein the device further comprises a bushing connector electrically coupled to the interrupter and enclosed by the housing.

* * * * *